United States Patent [19]

Hoffman

[11] 4,051,859

[45] Oct. 4, 1977

[54] APPARATUS FOR DRAINING FLUID FROM A CONTINUOUSLY EVACUATED SPACE

[76] Inventor: George John Hoffman, 37 Adrienne Place, Staten Island, N.Y. 10308

[21] Appl. No.: 400,735

[22] Filed: Sept. 26, 1973

[51] Int. Cl.[2] ..... B67D 5/54

[52] U.S. Cl. ..... 137/154; 137/216.1; 137/247.35

[58] Field of Search ..... 137/247.35, 216.1, 154; 62/228, 289

[56] References Cited

U.S. PATENT DOCUMENTS

| | | | |
|---|---|---|---|
| 214,304 | 4/1879 | Moore | 137/216.1 X |
| 493,750 | 3/1893 | Budde | 137/247.35 X |
| 664,945 | 1/1901 | Guion | 137/247.35 X |
| 733,475 | 7/1903 | Foley | 137/247.35 X |
| 743,094 | 11/1903 | McAuliffe | 137/247.35 X |
| 749,503 | 1/1904 | Tokheim | 137/216.1 X |
| 1,888,043 | 11/1932 | McCord | 62/288 X |
| 1,900,580 | 3/1933 | Moore | 62/288 |

*Primary Examiner*—Harold W. Weakley

*Attorney, Agent, or Firm*—Carella, Bain, Gilfillan & Rhodes

[57] ABSTRACT

Apparatus for permitting drainage of fluids from an evacuated space is disclosed to comprise a casing having a fluid inlet pipe, a drain fitting and a gas by-pass fitting. The fluid inlet pipe extends within a chamber defined by the apparatus body to a point substantially adjacent the bottom of the apparatus body. The drain fitting is displaced upwardly from the bottom of the apparatus body and permits passage of fluids from within the body chamber to a suitable drain connection. The gas by-pass fitting is disposed upwardly of the drain fitting and permits gas to pass inwardly through the drain fitting through the body chamber and out the gas by-pass fitting. The provision of the gas by-pass fitting permits drainage of fluids from an evacuated space to occur through the inlet pipe into the body chamber without being impeded by gas passing from the body chamber upwardly through the inlet pipe and into the space being drained.

1 Claim, 3 Drawing Figures

APPARATUS FOR DRAINING FLUID FROM A CONTINUOUSLY EVACUATED SPACE

BACKGROUND OF THE INVENTION

This invention relates to the field of piping and in particular this invention relates to equipment, sometimes designated as drain traps, for permitting the passage of fluid from one space to another.

More particularly, this invention relates to apparatus for permitting the passage of fluids from a space being continuously evacuated. Such a continuously evacuated space may be the unit area of a typical commercial air conditioning system and the apparatus of the present invention is disclosed in this context.

One of the problems facing those dealing with spaces being continuously evacuated wherein there is a tendency for the build up of fluids is the problem relating to removing the fluid from the space. Such a problem is found in the cooling coil area of typical commercial air conditioning units wherein the area is being continuously evacuated by the operation of the main air supply fan and the operation of the cooling coils causes condensation of water within the air stream.

The condensate formed on the cooling coils tends to be entrained in the air passing through the cooling coils and unless removed is passed from the unit area into the ductwork distribution system wherein it frequently occurs that the water will collect in ductwork and cause problems within the ductwork or more undesirably the water will leak from the ductwork causing damage to the interior spaces of the building being serviced.

Cooling coils have been provided with condensate pans in the bottom which are designed to collect condensate running downwardly by gravity effect across the cooling coil. Further, attempts have been made to eliminate any condensate which is carried off by the air by providing eliminators on the discharge side of the cooling coils which, by the provision of a maze-like air path, are intended to cause the disposition of entrained air on the surfaces of the eliminators and thereafter their gravity flow downwardly into the condensate pan which serves the cooling coils.

As will be recognized by those skilled in these arts, however, eliminators are not extremely efficient moisture removal devices and the known structures for permitting drainage of condensate from the condensate pans have been ineffective. The results of the ineffective drainage of fluid from the condensate pans have been that water build up occurs within the pan and reentrainment of the condensed water occurs thereby causing water carrying air to be passed into the ductwork distribution system.

It has been found in studies relating to the development of the present invention that a principal reason for the build up of water within condensate pans in known apparatus is that known trap type devices are ineffective to permit the passage of the condensate from the pan into a drain line. More specifically, it has been found that typical P traps and the like do not maintain their seal thereby permitting the passage of air from the atmosphere through the drain line and into the continuously evacuated unit casing. The passage of air into the unit casing through the condensate pan drain line is of such a magnitude as to preclude the passage of condensate in sufficient amounts out of the condensate pan and into the drainage system. Further, it has been found that the passage of air through the drain system has been sufficient to assist in the reentrainment of water otherwise condensed and collected in the condensate drain pan thus adding to the problem rather than eliminating it.

SUMMARY OF THE INVENTION

It is an object of the present invention therefore to provide a structure for permitting passage of fluids from a continuously evacuated space into a drain or other suitable removal line without suffering the consequences of gas passing from the drain area to the continuously evacuated space.

It is a further object of the present invention to provide a trapping apparatus for use with air conditioning systems which minimizes or eliminates the occurrence of water build up in unit condensate pans and the attendant difficulties resulting from entrained water in air being delivered to a distribution system.

Yet another object of the invention is to provide an apparatus for permitting the passage of fluid from a continuously evacuated space wherein the flow of gas through the apparatus inlet line (condensate drain line) is precluded.

These objects and others are achieved by the apparatus of the present invention which permits passage of fluid from a space at a first environmental pressure to a space at a second environmental pressure, the second environmental pressure being relatively higher than the first environmental pressure, the apparatus comprising a casing, a fluid inlet pipe extending into the casing for receiving fluid passing from the space at the first environmental pressure, a drain secured to the casing for draining fluids from the casing into the space at the second environmental pressure, and a gas by-pass means secured to the casing which defines a path of lesser resistance between the casing and the space at the first environmental pressure than is defined by the fluid inlet pipe.

BRIEF DESCRIPTION OF THE DRAWINGS

A more complete understanding of the present invention may be had from the following detailed description particularly when read in the light of the accompanying drawings wherein.

Figure 1:
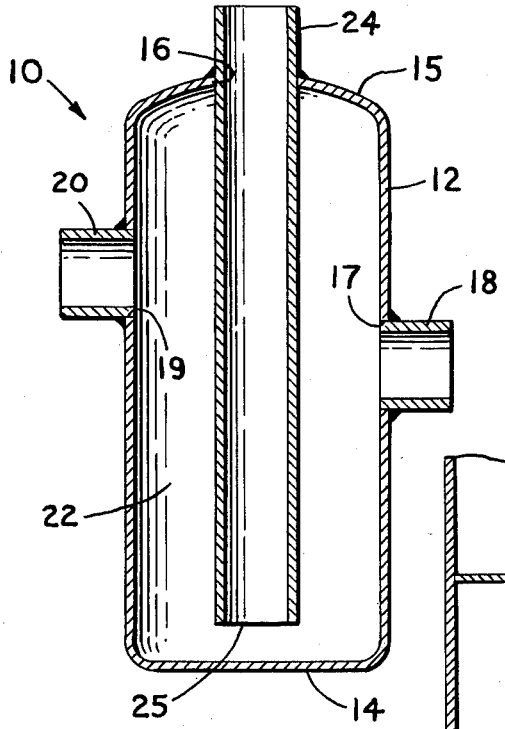
FIG. 1 is a cross-sectional elevational view of one embodiment of apparatus according to the present invention.

Considering therefore FIG. 1, an apparatus according to the present invention is shown and designated generally by the reference numeral 10. Apparatus 10 can be seen to comprise a casing having a generally cylindrical body 12 the bottom of which is closed by a wall 14 and the top of which is closed by a wall 15 having an axially extending bore 16 therein.

Disposed upwardly from the bottom 14 of body 12 is a radially directed bore 17 to which is rigidly secured a pipe 18 which defines a drain line connection fitting.

Disposed further upwardly from the bottom 14 of body 12 is a radially extending bore 19 having a pipe 20 rigidly secured thereto, pipe 20 defining a gas by-pass connection fitting.

Extending vertically axially downward into a chamber 22 defined by body 12, bottom wall 14 and top wall 15 is a pipe 24 which defines a condensate drain connection fitting. Pipe 24 extends from a point exterior to body 12 to an open end 25 at a point substantially adjacent but somewhat displaced from the upper surface of bottom wall 14. Thus, fluids passing inwardly of apparatus 10 through pipe 24 will build up in chamber 22 defined by a body 12 to a point adjacent the bottom of drain line fitting 18 whereupon drainage of the fluid from the apparatus to the drain line will occur. Because the level of fluid within apparatus 10 under ordinary operating conditions will not build up to a point above drain line fitting 18, the passage of gas through the chamber defined by body 12 will be permitted at all times through the drain line fitting and chamber out the gas by-pass connection fitting 20.

Figure 2:
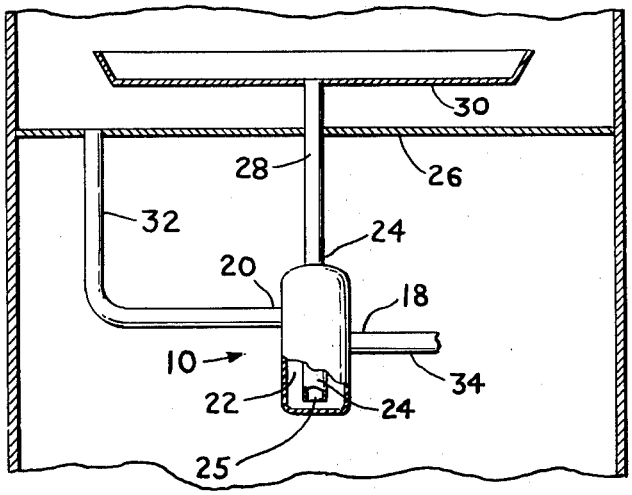
FIG. 2 is a schematic diagram of the apparatus of FIG. 1 in use with a typical commercial air conditioning system.

The value of this arrangement will become apparent with reference to FIG. 2 which shows an apparatus 10 installed for operation in a typical air conditioning system which may include a casing wall 26 within which is mounted a condensate collecting pan 27.

More specifically, it can be seen that the inlet fitting 24 of apparatus 10 is connected by pipe 28 to the drain line connection of a condensate pan 30. The condensate pan 30 is located within a unit casing 26 which is under a negative pressure, e.g. 1½ to 2 inches water gauge, by reason of the operation of a main air supply fan of the air conditioning system. The condensate pan 30 is adapted to collect condensed water from the cooling coil or coils and eliminator or eliminators (not shown).

Secured to gas by-pass connector 20 is a pipe 32 which extends through unit casing 26 and into the unit so as to place the chamber 22 of apparatus 10 into fluid communication with the interior of the unit casing. Thereafter, a suitable drain connection 34 may be made to drain line connection fitting 18 and the apparatus is ready for operation.

Thus, assuming that the air conditioning system with respect to which the apparatus is installed is in operation, a fluid build up tends to occur on condensate pan 30 and the condensate flows downwardly through pipe 28 into apparatus 10 through fluid inlet pipe 24. Build up of fluid occurs within chamber 22 until such time as the fluid achieves the level of drain line connection fitting 18 at which time it is discharged from the chamber through the drain line. During the period of filling and thereafter, gases are permitted to pass, e.g. air from the atmosphere, through the drain line piping 34 into chamber 22 and thereafter into the air conditioning system through gas by-pass line 32. The present invention contemplates that the resistance to flow defined by the gas by-pass passage will be less than the resistance to flow defined by the fluid inlet (condensate) thereby minimizing the tendency of gas to pass from within the chamber 22 of apparatus 10 through the fluid inlet line 24 and pipe 28 into the system by way of the drain connection of condensate pan 30. Rather, the tendency of gas being induced into the system by the negative pressure of the system through the trap device will be through the gas by-pass line. Of course, once a sufficient amount of fluid has been collected within the apparatus 10 to cover the bottom 25 of pipe 24, all gas being induced through the trapping apparatus into the air conditioning unit will be passed from the drain line through the gas by-pass line. In this regard, any startup difficulty can be alleviated by priming the trap, i.e. by providing a sufficient amount of water in the bottom of the trap to cover the bottom 25 of fluid inlet pipe 24.

It can be seen from the foregoing that the problems defined above relating to the tendency of air to be induced through a trapping apparatus and upwardly into an air conditioning unit through a condensate pan drain connection are eliminated by the apparatus of the present invention and the manner in which it is associated with the system. In practice apparatus according to the invention have been installed in systems wherein major flooding of the air conditioning units and distribution systems has occurred with grave damage to the equipment and interior spaces of the building being serviced. Immediately upon the installation of apparatus according to the present invention the flooding problem ceased and no further difficulties have been experienced.

Figure 3:
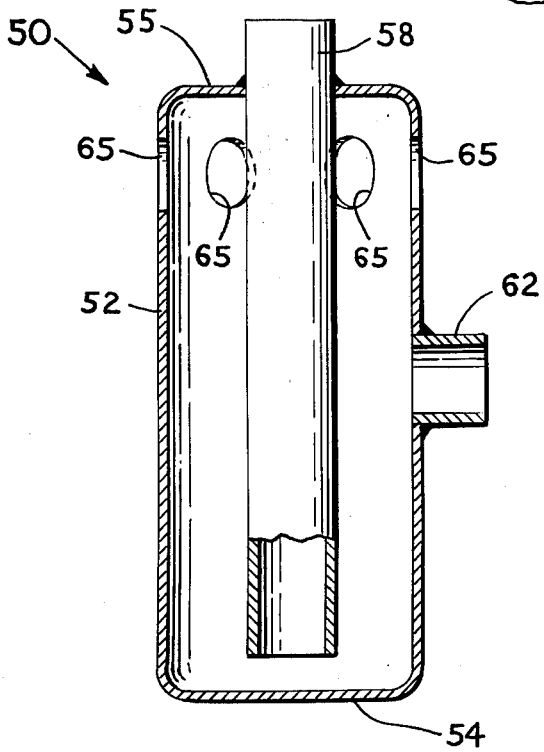
FIG. 3 is a cross-sectional elevational view of a second embodiment of apparatus according to the present invention.

Referring now to FIG. 3, a second embodiment of apparatus according to the invention is shown and designated generally by the reference numeral 50. Apparatus 50 is seen to comprise a generally cylindrical body 52 having a closure wall 54 at the bottom end thereof and a closure wall 55 at the top end thereof. Extending downwardly through the upper closure wall 55 is a fluid inlet line 58 which, in the manner discussed above with respect to apparatus 10, extends downwardly within a chamber defined by body 52 to a point above but somewhat adjacent the bottom wall 54 of apparatus 50. Disposed above the bottom of pipe 58 is a drain fitting connection 62 which is adapted for connection to a drain line in the manner discussed above with respect to apparatus 10.

Above the level of drain connection fitting 62 are a plurality of apertures 65 which communicate the interior of apparatus 10 with the environment in which the apparatus is installed. Thus the particular utility of apparatus 50 is when installation of the trap is within the continuously evacuated space.

The operation of trap device 50 is substantially identical to that discussed above with respect to apparatus 10. More specifically, inlet line 58 is connected to a condensate drain discharge of a condensate pan within the unit and drain line fitting 62 is connected to a typical drain line discharge. Fluid passing from the condensate pan passes into apparatus 50 through the fluid inlet line 58 wherein it is collected and thereafter passed out the drain line 62. Gas being induced from the atmosphere through the drain line system passes into apparatus 50 through the drain line and thereafter is passed into the system environment through openings 65. Thus, passage of gas upwardly through the fluid inlet line and thereafter through the condensate pan is avoided and drainage is permitted without the occurrence of likelihood of entrainment of water in air passing through the system.

It will be recognized by those skilled in the art that the apparatus according to the invention may be constructed using conventional methods and conventional materials, e.g. bronze, galvanized metal, steel and the like. Drain line connections and gas by-pass connections may be conventional hoses of the garden hose variety or other suitable pipes, e.g. copper pipe and the like.

It is considered to be manifest that many modifications and variations to the foregoing disclosed embodiments may be made without departing from the spirit and scope of this invention.

What is claimed is:

1. Apparatus for draining fluid from a continuously evacuated space at first environmental pressure to a space at a second environmental pressure said second environmental pressure being relatively higher than said first environmental pressure, comprising:

collecting means in said continuously evacuated space at said first environmental pressure for collecting said fluid;

trap means, said trap means comprising; a casing defining a chamber therein said casing having a bottom wall and a top wall, a fluid inlet line extending into said chamber, to a discharge point substantially adjacent to said bottom wall, a fluid drain line extending out of said chamber, said fluid drain line disposed in said casing at a position above said discharge point of said fluid inlet line, and a gas bypass line extending out of said chamber, said gas bypass line disposed in said casing at a position above the position of said fluid drain line;

means for communicating said fluid inlet line to said collecting means;

means for communicating said fluid drain line to said space at said second environmental pressure;

means for communicating said fluid drain line to said gas bypass line; and means for communicating said gas bypass line to said continuously evacuated space at said first environmental pressure.

* * * * *